US008171997B2

(12) United States Patent
Olson et al.

(10) Patent No.: US 8,171,997 B2
(45) Date of Patent: May 8, 2012

(54) HIGH VELOCITY STRING FOR WELL PUMP AND METHOD FOR PRODUCING WELL FLUID

(75) Inventors: David L. Olson, Los Alamitos, CA (US); Josh T. Prather, Acton, CA (US); David B. Dillon, Parker, CO (US); Ray A. Watson, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 691 days.

(21) Appl. No.: 12/328,884

(22) Filed: Dec. 5, 2008

(65) Prior Publication Data

US 2009/0145612 A1 Jun. 11, 2009

Related U.S. Application Data

(60) Provisional application No. 60/992,588, filed on Dec. 5, 2007.

(51) Int. Cl.
*E21B 43/00* (2006.01)

(52) U.S. Cl. ..... 166/369; 166/68; 166/54.1; 166/105

(58) Field of Classification Search ..... 166/369, 166/68, 54.1, 105, 370
See application file for complete search history.

(56) References Cited

U.S. PATENT DOCUMENTS

| | | | | |
|---|---|---|---|---|
| 5,746,582 | A | 5/1998 | Patterson | |
| 6,123,149 | A | 9/2000 | McKinzie et al. | |
| 6,193,474 | B1 | 2/2001 | Tetzlaff | |
| 6,371,206 | B1 * | 4/2002 | Mills | 166/311 |
| 6,729,391 | B2 | 5/2004 | Hill et al. | |
| 6,923,275 | B2 | 8/2005 | Gardes | |
| 7,243,738 | B2 | 7/2007 | Gardes | |
| 7,264,494 | B2 | 9/2007 | Kennedy et al. | |
| 2006/0243450 | A1 | 11/2006 | Head | |
| 2007/0074871 | A1 | 4/2007 | Olson et al. | |

OTHER PUBLICATIONS

U.S. Appl. No. 12/271,624, filed Nov. 14, 2008.

* cited by examiner

*Primary Examiner* — Giovanna Wright
*Assistant Examiner* — Yong-Suk Ro
(74) *Attorney, Agent, or Firm* — Bracewell & Giuliani LLP

(57) ABSTRACT

A method of producing a well fluid includes securing a motor to a string of outer tubing and lowering the outer tubing and motor into the well. A rotary pump is secured to a string of inner tubing and lowered into the outer tubing. The pump stabs into cooperative engagement with the motor. Supplying power to the motor rotates the pump, causing well fluid to flow into the outer tubing to an intake of the pump, which pumps the well fluid through the inner tubing to an upper end of the well. Removing the well fluid allows gas to flow up an annulus surrounding the outer tubing to the upper end of the well.

21 Claims, 6 Drawing Sheets

HIGH VELOCITY STRING FOR WELL PUMP AND METHOD FOR PRODUCING WELL FLUID

CROSS-REFERENCE TO RELATED APPLICATION

This application claims priority to and the benefit of provisional application Ser. No. 60/992,588, filed Dec. 5, 2007.

FIELD OF THE INVENTION

This invention relates in general to well pumps, and in particular to a well pump system using a progressive cavity pump that discharges through a high velocity tubing string.

BACKGROUND OF THE INVENTION

Submersible pumping systems are often used in hydrocarbon producing wells for pumping fluids from within the well bore to the surface. These fluids are generally liquids and include produced liquid hydrocarbon as well as water. One type of system employs an electrical submersible pump (ESP). ESP's are typically disposed at the end of a length of production tubing and have an electrically powered motor. Often, electrical power may be supplied to the pump motor via cable strapped to the exterior of the production tubing. Another system uses progressing cavity pumps (PCP), which are positive displacement pumps that consist of a helical steel rotor inside a synthetic elastomer stator bonded to a steel tube. As the rotor turns within the stator, fluid moves through the pump from cavity to cavity. The resulting pumping action increases the pressure of the fluid, allowing production to the surface.

One technique involves suspending an electrical motor on a string of production tubing in the well. A progressing cavity pump is lowered through the production tubing and stabs into engagement with the previously installed motor. A line, which may be a wireline, is used to lower the pump through the production tubing is retrieved. Supplying power to the motor rotates the rotor of the pump, which pumps well fluid out the upper end of the pump into the production tubing.

While this technique works fine in many wells, in some wells, debris in the well fluid can settle out and drift down onto the pump, eventually hampering flow. For example, in coal bed methane producing wells, the pump is employed for dewatering, and the gas flows up the annulus surrounding the production tubing. Coal fines are typically entrained in the water and tend to accumulate. This accumulation requires subsequent cleanout.

SUMMARY OF THE INVENTION

In this invention, the well fluid pumped by the pump is produced up an inner tubing string rather than the production tubing. A motor is secured to a string of outer tubing and lowered into the well. A rotary pump is secured to a string of inner tubing and lowered into the outer tubing. When the pump reaches the motor, it stabs into cooperative engagement with the motor. The operator leaves the inner tubing string attached to the discharge of the pump.

Supplying power to the motor rotates the pump, causing well fluid to flow into the outer tubing and to an intake of the pump. The pumps discharge the well fluid into the inner tubing, which flows to an upper end of the well. If the well produces gas, such as a coal bed methane well, the gas flows up the annulus surrounding the production tubing.

DETAILED DESCRIPTION OF THE INVENTION

Figure 1:
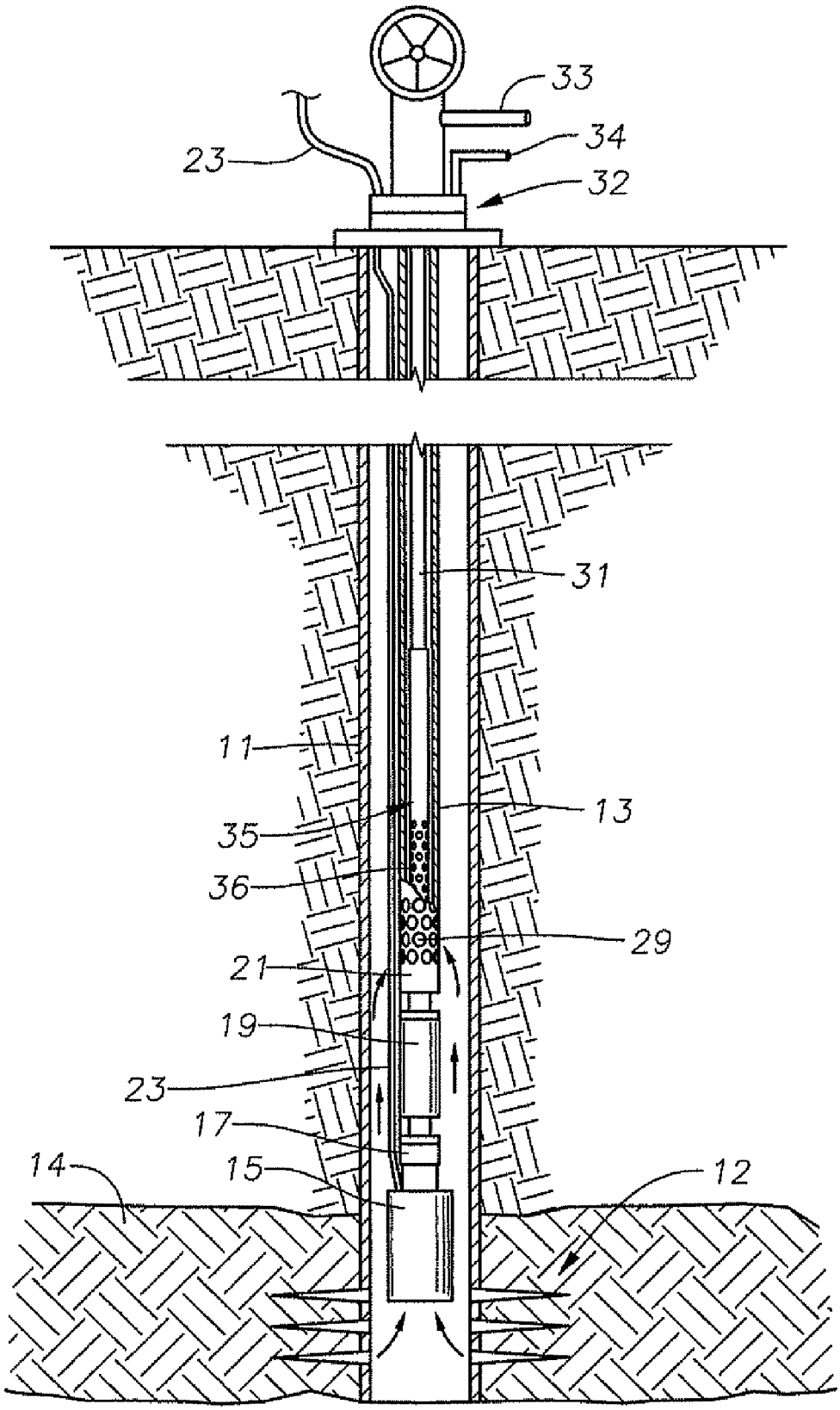
FIG. 1 is a schematic sectional view of a progressing cavity pump attached to a high velocity tubing string and located within an outer tubing string that has a motor at its lower end.

Referring to FIG. 1, the well contains a casing 11 that is shown cemented in place. Casing 11 has an opening for fluid ingression, such as perforations 12 in earth formation 14. Casing 11 may have an upper portion located within a larger diameter string of casing (not shown). Casing 11 alternately could be a liner having an upper end landed near a lower end of a larger diameter string of casing. The well is shown as vertical, but it could be inclined.

A string of outer tubing 13 is shown supported in casing 11. Outer tubing 13 is typically made up of sections of conduit, each approximately thirty feet in length, that are screwed together to make up a string. The upper end of outer tubing 13 is supported at the wellhead. Outer tubing 13 is not cemented in the wellbore, thus is not considered to be a casing. In the prior art, tubing of this nature is typically the conduit through which production fluids flow to the surface.

A motor 15 is carried at the lower end of outer tubing 13. Motor 15 is an electrical motor in this example but it could alternately be another type, such as a hydraulic motor. Motor 15 is connected to a gear box 17 to reduce the speed of rotation in motor 15. Gear box 17 is connected to a seal section 19 that reduces pressure differential between lubricant in motor 15 and the well bore fluid in casing 13. Seal section 19 is attached to an intake housing 21, which in turn connects to a lower end of outer tubing 13. A power line or cable 23 extends alongside outer tubing 13 to motor 15 for supplying power to operate motor 15. In this embodiment, motor 15 has a larger outer diameter than a drift inner diameter of tubing 13, but it could be smaller. The drift inner diameter is considered to be the nominal inner diameter throughout the length of outer tubing 13.

Intake housing 21 has a plurality of intake ports 29 for receiving well fluid from casing 11. The producing formation in this example produces gas and water, but the well could alternately or also produce oil. The well fluid flowing into intake housing 21 is principally a liquid, normally water and/or oil. The well fluid in this example also contains gas, which separates from the water by gravity and flows up the outer tubing annulus in casing 11 surrounding outer tubing 13. In this example, the water is removed from the well to prevent a buildup of water diminishing the gas flow.

A string of inner tubing 31 is installed within outer tubing 13. Inner tubing string 31 may be made up of sections of conventional small diameter conduit screwed together; or it may be made up of coiled tubing. Both inner tubing 31 and outer tubing 13 are suspended at the surface by a wellhead 32. Wellhead 32 has a water outlet 33 in fluid communication with inner tubing 31. Wellhead 32 has a gas outlet 34 in fluid communication with the outer tubing annulus surrounding outer tubing 13.

A rotary pump 35 is secured to the lower end of inner tubing 31. Pump 35 is stabbed into cooperative engagement with motor 15. Intake ports 36 in the assembly of pump 35 draw well fluid that has flowed in through intake housing ports 29. The well fluid flows to pump 35 and is pumped up inner tubing 31 and out water outlet 33.

Figure 2:
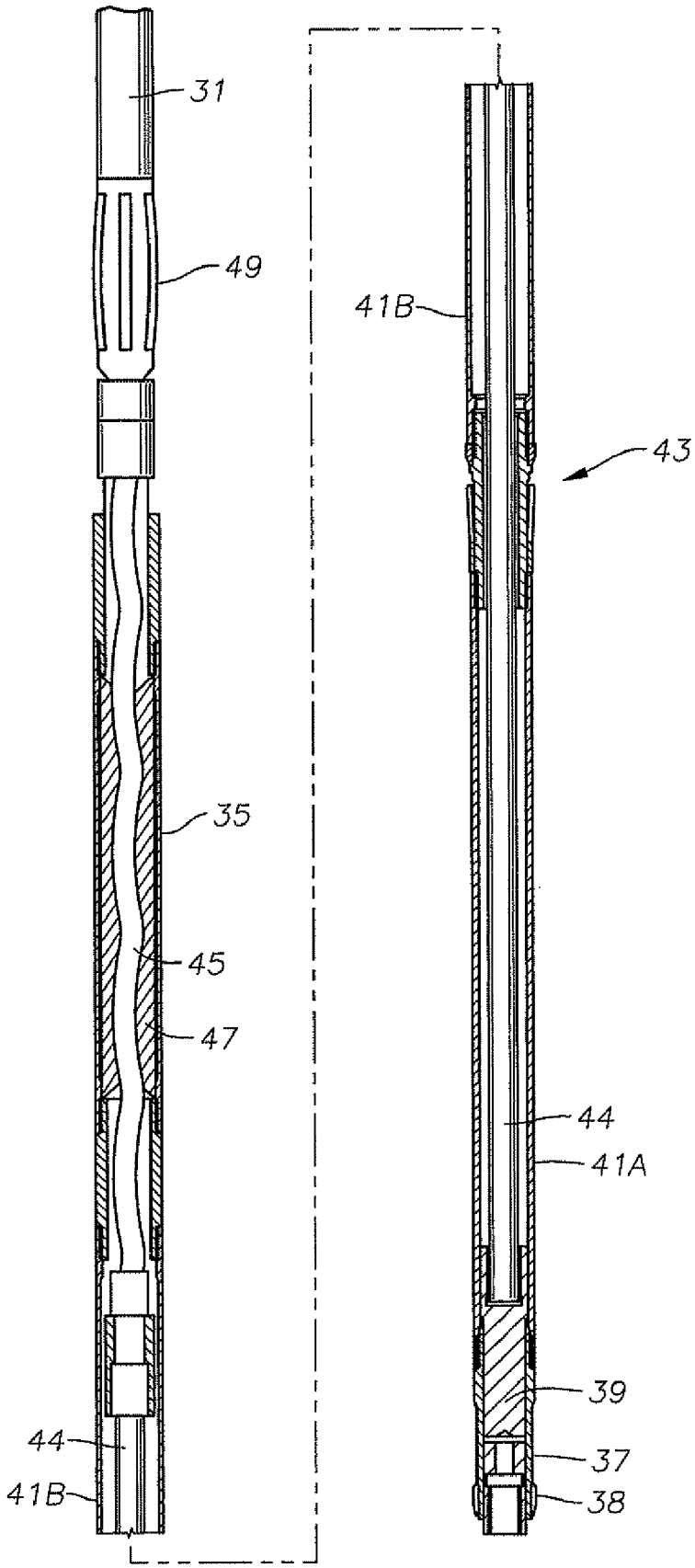
FIG. 2 is an enlarged sectional, schematic view of the progressive cavity pump assembly of FIG. 1, shown apart from the outer tubing string.

FIG. 2 shows the inner string made up of inner tubing 31 and pump 35 apart from outer tubing 13. Pump 35 has a non-rotating base housing 37 on its lower end. An anti-rotation ring 38 is located on base 37. Base 38 and/or anti-rotation ring 38 may have one or more external axial groove for sliding into mating key or keys when pump 35 engages motor 15 (FIG. 1). A rotatable base coupling 39 is carried in base housing 37. Base coupling 39 has a splined receptacle on its lower end for cooperative engagement with motor 15 (FIG. 1).

Pump 35 could be of different rotary types, such as a centrifugal pump, a progressive cavity pump or a screw pump. In this example, it comprises a progressive cavity pump that optionally includes lower and upper flex shaft housings 41A and 41B extending downward and coupled to base housing 37. A flex shaft 44, located within flex shaft housings 41A and 41B, has a lower end connected to base coupling 39. Flex shaft 44 is a long rod, usually of metal, that is restrained by bushings at its lower end to rotate concentrically on a single axis. Lower flex shaft housing 41A extends into intake housing 21 (FIG. 1). Intake ports 36 are located within lower flex shaft housing 41A as shown in FIGS. 3*a* and 3*b*, thus lower flex shaft housing 41A serves as an intake housing for pump 35.

Flex shaft 44 is attached on its upper end to a rotor 45 of progressing cavity pump 35. Rotor 45 has a double helical exterior and is normally made of metal such as steel. Rotor 45 is rotated by flex shaft 44 within an elastomeric stator 47, which in turn is bonded within a steel housing. Stator 47 has an inner cavity that has a single helical configuration. When rotor 45 is rotated within stator 47, it will pump fluid upward. Because of the helical configurations of rotor 45 and stator 47, rotor 45 orbits about a central axis rather than concentrically on the axis. Flex shaft 44 accommodates the orbital motion by flexing and orbiting at its upper end while its lower end rotates about a single axis.

In this example, flex shaft housings 41A and 41B are optionally connected together by seal and latch sub 43, which will be explained subsequently. A centralizer 49 may be mounted between the upper end of pump 35 and the lower end of inner tubing 31. Centralizer 49 engages the inner diameter of outer tubing and serves to center pump 35 within outer tubing 13. The outer diameter of progressive cavity pump 35 is larger than the drift inner diameter of inner tubing 31. The drift inner diameter of inner tubing 31 is selected to be sufficiently small to increase the well fluid velocity flowing through pump 35 enough to significantly reduce debris entrained in the water from falling downward in inner tubing string 31 and building up on pump 35.

Figure 3A:
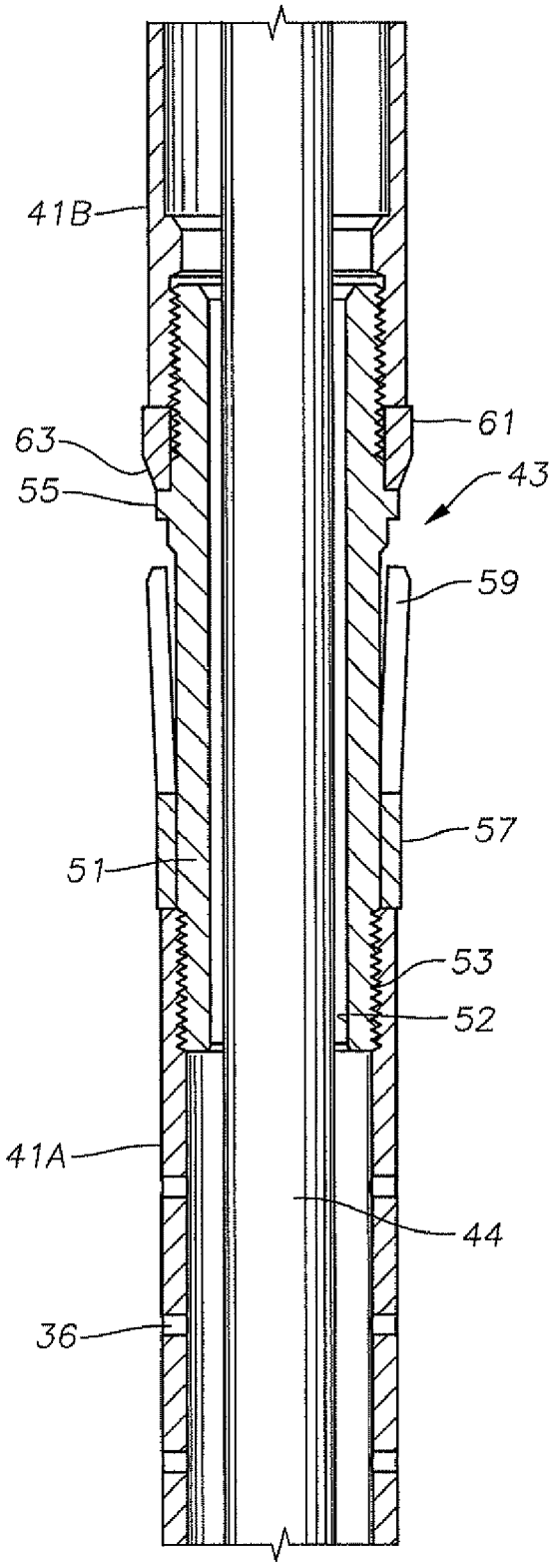
FIGS. 3*a* and 3*b* comprise a further enlarged sectional view of a lower portion of the progressive cavity pump assembly of FIG. 1, shown apart from the outer tubing string.
Figure 3B:
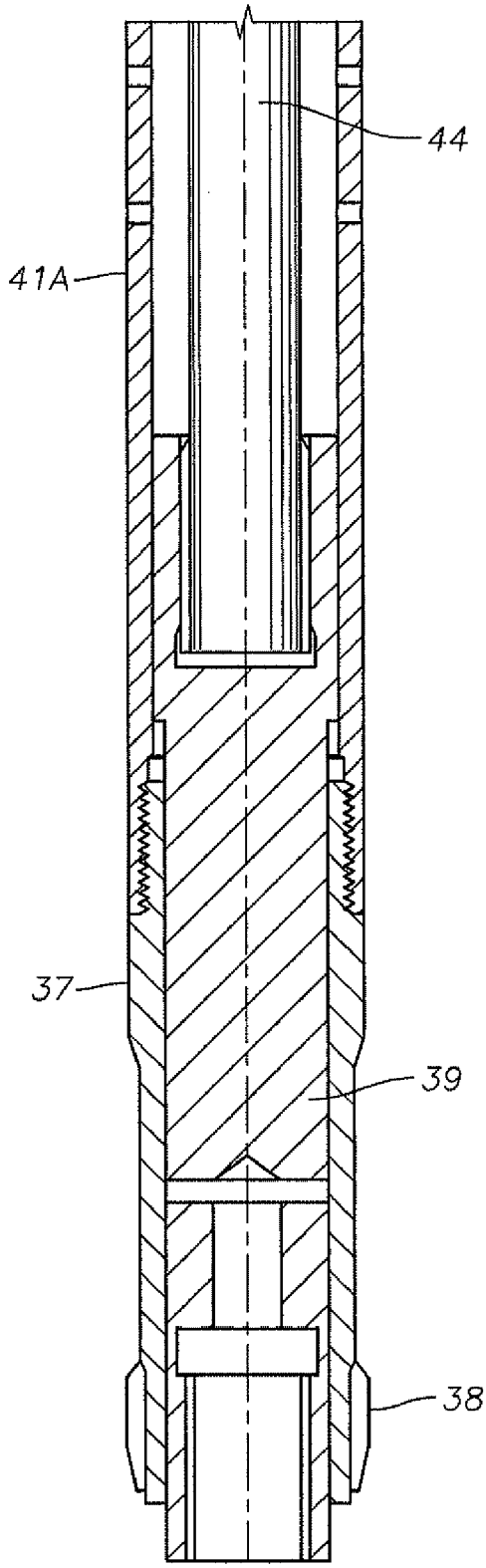

FIGS. 3*a* and 3*b* comprise an enlarged view of a portion of flex shaft housings 41A and 41B removed from outer tubing 13 (FIG. 1). Seal and latch sub 43 includes a tubular nipple 51 that has a bore 52 larger in diameter than flex shaft 44. Nipple 51 has external threads 53 on its lower end that secure to threads in the upper end of lower flex shaft housing 41A. The upper end of nipple 51 also has external threads, and they secure to the lower end of upper flex shaft housing 41B. A stop member or band 55 encircles nipple 51 on its exterior between threads 53 on the upper and lower ends.

A collet 57, carried on nipple 51 below band 55, serves as a latch. Collet 57 has a lower circular base that engages the upper end of lower flex shaft housing 41A. Collet 57 may be free to slide axially a limited distance on nipple 51. A plurality of collet fingers 59 extend upward from the base, each having an upper end that is free. Collet fingers 59 are biased outward so that the outer diameter circumscribed by the free ends is greater than the outer diameter of the base of collet 57. Collet fingers 59 are free to flex radially inward.

An energizing ring 61 is sandwiched between the lower end of upper flex shaft housing 41B and band 55. In this embodiment, energizing ring 61 has an external chamfer or conical portion 63 that is located on its exterior. Conical portion 63 tapers inwardly in a downward direction. Energizing ring 61 serves as part of a seal that will be explained subsequently.

Figure 4A:
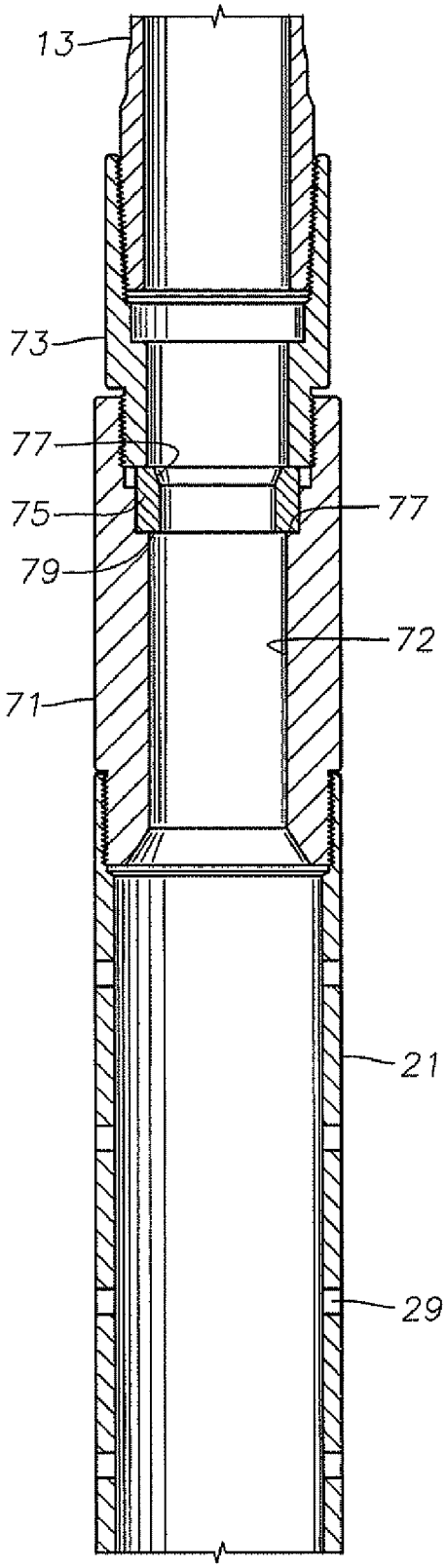
FIGS. 4*a* and 4*b* comprise an enlarged sectional and schematic view of a lower portion of the outer tubing string and motor of FIG. 1, shown apart from the inner tubing string.
Figure 4B:
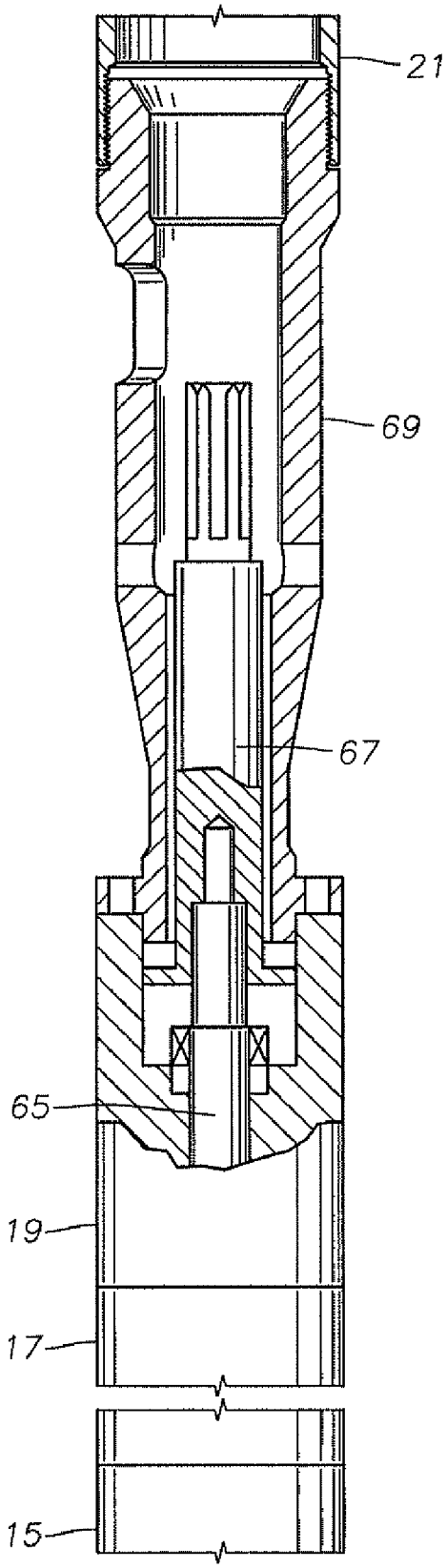

FIGS. 4*a* and 4*b* show an enlarged portion of the lower end of the outer string made up of outer tubing 13 (FIG. 1) and motor 15 prior to installing the inner string made up of inner tubing 31 (FIG. 1) and pump 35. Motor 15 rotates a seal section shaft 65 that extends upward from seal section 19. A rotatable coupling shaft 67 is mounted to the upper end of shaft 65 and enclosed within an adapter 69. The lower end of intake housing 21 secures to the upper end of adapter 69 by threads. Adapter 69 has one or more keys 70 that protrude radially into the bore of adapter 69.

In this example, a seal and latch housing 71 mounts to the upper end of intake housing 21. Seal and latch housing 71 is a tubular member, preferably having a bore 72 with an inner diameter at least equal to the drift inner diameter of outer tubing 13. A seating nipple 73 is secured by threads to the upper end of seal and latch housing 71. The lower end of outer tubing 13 is secured by threads to seating nipple 73. A seal ring 75 is located on an upward facing shoulder 77 in seal and latch housing 71. The lower end of seating nipple 73 abuts the upper edge of seal ring 75, preventing any axial movement of seal ring 75. In this embodiment, seal ring 75 has a chamfer 77 at its upper end on its inner diameter. The inner diameter of seal ring 75 is preferably less than the drift inner diameter of outer tubing 13. The lower end of seal ring 75 protrudes radially into bore 72, defining a downward facing shoulder 79. Seal ring 75 is preferably made from a metal.

Figure 5A:
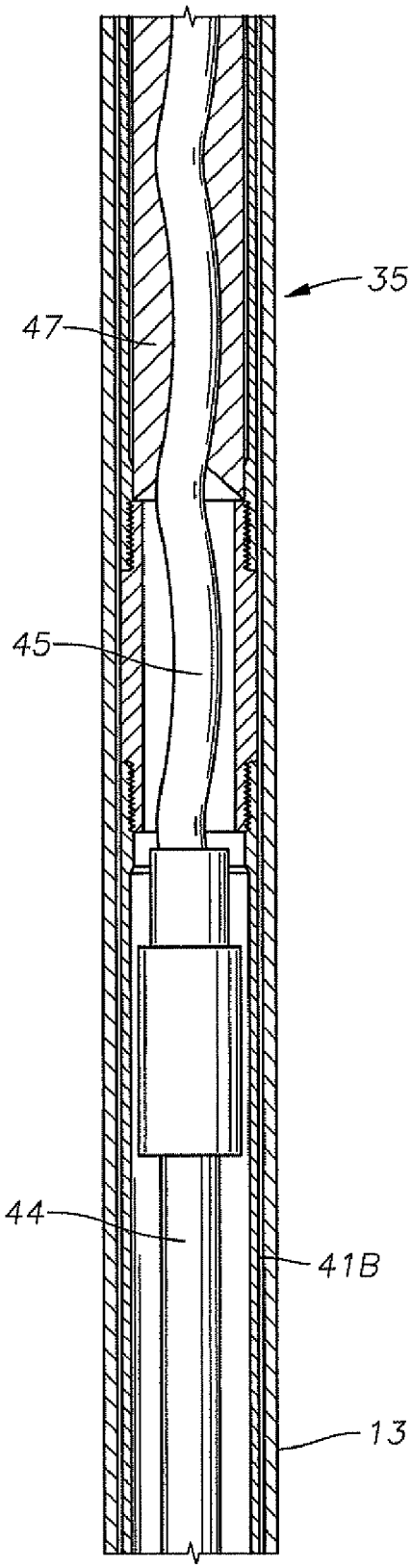
FIGS. 5*a*-5*c* comprise an enlarged sectional and schematic view of the inner string of FIG. 1 installed within the outer string of FIG. 1.
Figure 5B:
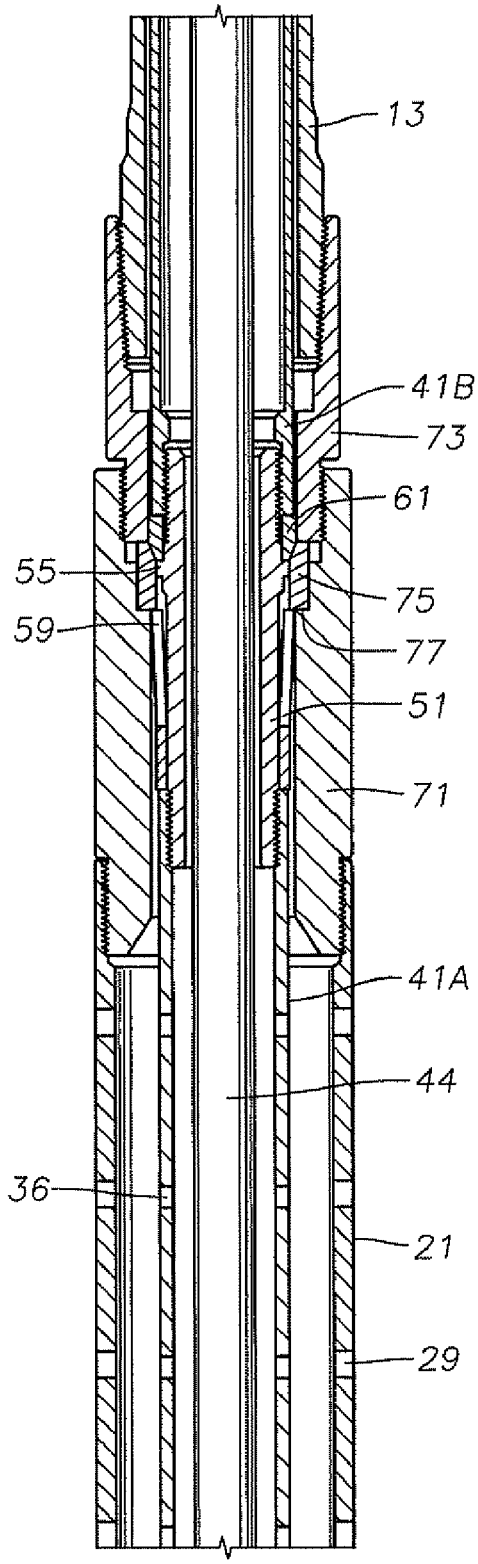
Figure 5C:
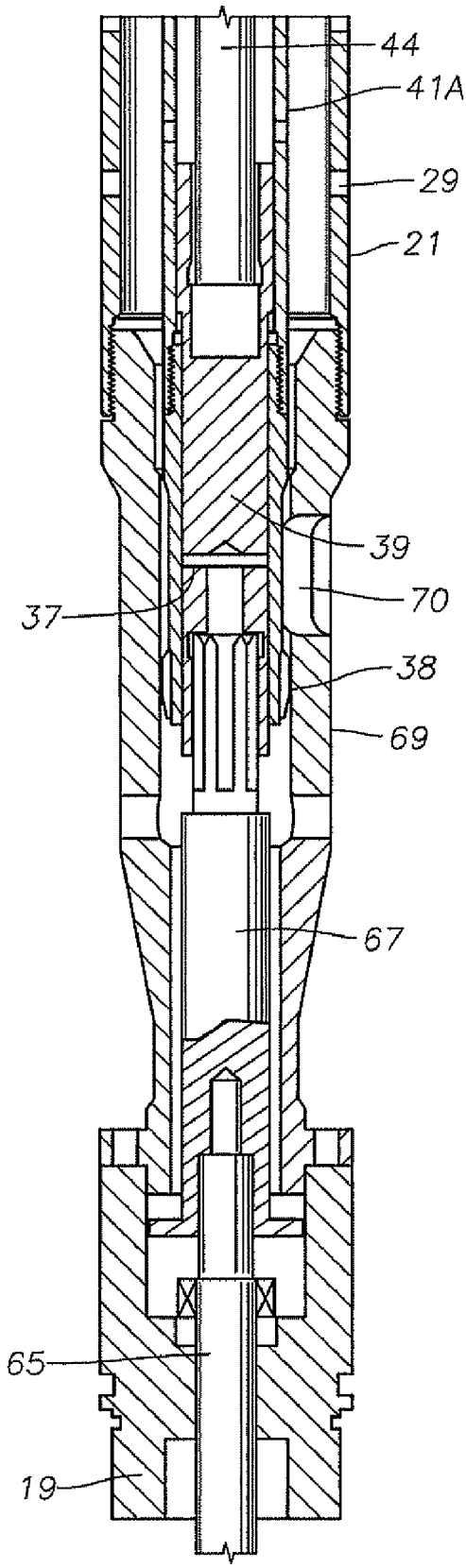

FIGS. 5*a*-5*c* show pump 35 installed in outer tubing 13 and coupled to motor 15. As pump 15 is lowered on inner tubing 31 (FIG. 2), base coupling 39 will stab into engagement with coupling shaft 67 as shown in FIG. 5*c*. Base housing 37 and ring 38 slide into engagement with the key 70 in adapter 69. As shown in FIG. 5*b*, energizing ring 61 lands on seal ring 75, deforms seal ring 75 outward and forms a seal of the inner annulus between nipple 51 and bore 72 of seal and latch housing 71. Band 55, which may have an outer diameter slightly larger or smaller than the initial inner diameter of seal ring 75, locates within the inner diameter of seal ring 75. As the inner string moves downward, collet fingers 59 slide downward on the inner diameter of outer tubing 13. As the free ends of fingers 59 slide past seal ring 75, they snap outward into engagement with bore 72 of seal and latch housing 71. Any upward movement of the inner string will be resisted by the abutment of fingers 59 with shoulder 77.

Figure 6:
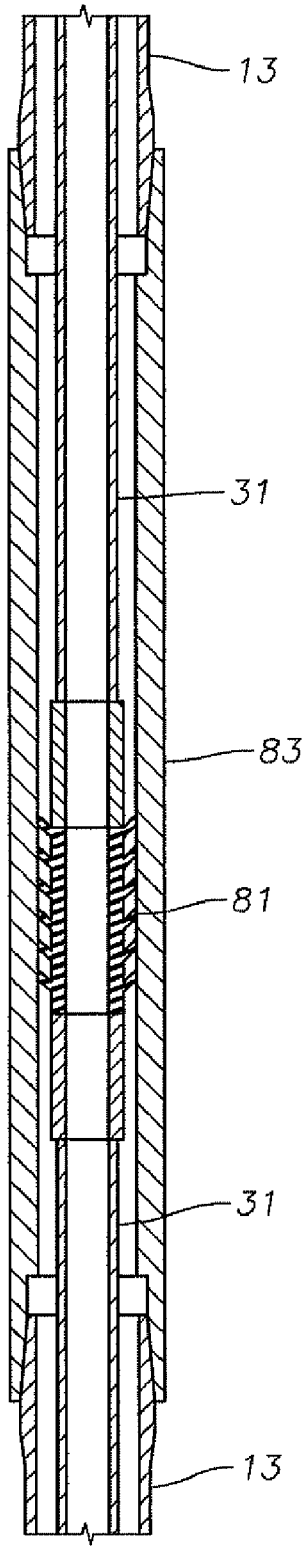
FIG. 6 is a sectional view of a cup seal sealing between the inner and outer tubing strings near their upper ends.

Referring to FIG. 6, preferably the upper end of the inner annulus between inner tubing 31 and outer tubing 13 is sealed to prevent debris carried in the liquid flowing out of the upper end of inner tubing 31 from flowing back down into the inner annulus. In this example, the sealing arrangement includes a series of cup seals 81 connected into the string of inner tubing 31 near wellhead 32 (FIG. 1). Cup seals 81 are shown in sealing contact with a smooth-bore mandrel 83 connected into the string of outer tubing 13. Mandrel 83 could be located a short distance below wellhead 32. Alternately, packoff arrangements in the inner annulus within wellhead 32 could be employed.

In operation, the operator will first drill and case a well with casing 11. The operator attaches motor 15 and intake housing 21 to the lower end of outer tubing 13. The operator lowers the outer string assembly into the well while strapping power cable 23 alongside outer tubing 13. When at the desired depth, the operator will secure a hanger to the upper end of outer tubing 13 and support it within wellhead 32. The operator then attaches progressive cavity pump 35 and its flex housings 41A and 41B (FIG. 2) to inner tubing string 31. The operator lowers the assembly through outer tubing 13 until seal and latch sub 43 engages seal and latch housing 71. As this occurs, as shown FIG. 5*c*, base coupling 39 will slide into mating engagement with coupling shaft 67 (FIG. 5*c*). Energizing ring 61 will sealingly engage seal ring 75 and collet fingers 59 will latch to shoulder 79.

The operator then supplies power to motor 15, which rotates base coupling 39, flex shaft 44 and rotor 45. Stator 47 does not rotate because of the anti-rotational engagement of lower intake housing 41B with adapter 69. The rotation of rotor 45 causes liquid collecting in casing 11 (FIG. 1) to flow through intake ports 29 and 36. The liquid flows up around flex shaft 44, and is pumped by pump 35 into inner tubing string 31. The water flows to wellhead 32 through inner tubing string 31 for disposal. The velocity of the water is preferably sufficient to minimize fine grains of debris from drifting downward onto pump 35.

In this example, gas being produced by the well will flow up the annulus in casing 11 surrounding outer tubing 13. Perforations 12 in casing 11 to the gas and water production zone 14 optionally may be located above intake ports 29 to reduce the tendency for gas to be drawn into progressive cavity pump 35.

When the operator wishes to retrieve pump 35, an over pull on inner tubing 31 will cause collet fingers 59 (FIG. 5*b*) to dislodge from engagement with shoulder 77. This releases the latch retaining pump 35, allowing the inner string to be retrieved while outer tubing 13 and motor 15 remain suspended in the well.

While the invention has been shown in only one of its forms, it should be apparent to those skilled in the art that it is not so limited but is susceptible to various changes without departing from the scope of the invention. For example, a variety of latch and sealing mechanisms may be employed to latch the pump and seal the inner annulus other than the one shown. Also, latching the pump may not be always necessary because the pump is retained at the lower end of the outer tubing by means of the inner tubing.

In addition, rather than connect the motor to the string of outer tubing and lower the motor with the outer tubing, it could be connected to the pump assembly at the surface and lowered through the outer tubing. The power cable would be located on the exterior of the outer tubing string and have electrical contacts on the inside of the outer tubing string near its lower end. The motor would have electrical contacts that make up with electrical contacts attached to the outer tubing string when the pump and motor reach the lower end of the outer tubing string. In that method, the pump and motor would be connected together at the surface, connected to the inner tubing and lowered as a unit within the outer tubing.

The invention claimed is:

1. A method of producing a well fluid, comprising:

(a) securing a motor assembly to a string of outer tubing, defining an outer string, lowering the outer string along with the motor assembly into the well, and supporting an upper end of the outer string in a wellhead at an upper end of the well;

(b) securing a rotary pump assembly to a string of inner tubing, defining an inner string, lowering the inner string into the outer string, stabbing the pump assembly into cooperative engagement with the motor assembly, and supporting an upper end of the inner string in the wellhead; and (c) supplying power to the motor assembly to operate the pump assembly, causing well fluid to flow into the outer string to an intake of the pump assembly, which pumps the well fluid through the inner tubing to an upper end of the well.

2. The method according to claim 1, wherein step (b) further comprises sealing the inner string to the outer string at a point above the intake of the pump assembly.

3. The method according to claim 1, wherein:

step (a) further comprises providing an outer string intake port in the outer string above the motor assembly; and step (c) comprises flowing well fluid through the outer string intake port.

4. The method according to claim 3, wherein:

step (b) further comprises mounting an intake housing to a lower end of the pump assembly, providing the intake housing with an intake housing port above its lower end, and stabbing the intake housing into cooperative engagement with the motor assembly; and step (c) comprises flowing well fluid from the outer string intake port into the intake housing port.

5. The method according to claim 1, wherein step (b) further comprises latching the inner string to the outer string as the pump assembly is stabbed into cooperative engagement with the motor assembly.

6. The method according to claim 1, wherein step (b) further comprises latching and sealing the inner string to the outer string as the pump assembly is stabbed into cooperative engagement with the motor assembly.

7. A method of producing a well fluid, comprising:

(a) securing a power line to an exterior of an outer string of tubing and from a wellhead at an upper end of a well, suspending the outer string and the power line in the well with an upper end of the outer string being within the wellhead;

(b) securing a rotary pump assembly to a string of inner tubing, defining an inner string, lowering the inner string along with the pump assembly into the outer string and supporting an upper end of the inner string within the wellhead; and (c) supplying power through the power line to the pump assembly to operate the pump assembly, causing well fluid to flow into the outer string to an intake of the pump assembly, which pumps the well fluid through the inner string to an upper end of the well.

8. The method according to claim 7, wherein:

step (a) comprises securing an electrical motor to the outer string and lowering the electrical motor into the well with the outer string; and step (c) comprises supplying electrical power to the electrical motor.

9. The method according to claim 7, wherein step (b) further comprises latching the inner string to the outer string to resist upward movement of the inner string relative to the outer string.

10. The method according to claim 7, wherein step (b) further comprises latching the inner string to the outer string at a point below a pump of the pump assembly and sealing the inner string to the outer string at point below the pump.

11. A well production apparatus, comprising:

an outer string of outer tubing for suspension in a well;

a power line secured to an exterior of the outer tubing;

a string of inner tubing that is lowered into the outer string, the outer string and the string of inner tubing having upper ends adapted to be supported within a wellhead at an upper end of the well; and a rotary pump assembly at a lower end of the inner tubing, defining an inner string that is located within and lands in the outer string, the pump assembly being in cooperative engagement with the power line for supplying power to operate the pump assembly, the pump assembly having a pump intake in fluid communication with well fluid in the outer string and a discharge in fluid communication with the inner tubing for discharging well fluid up the inner tubing.

12. The apparatus according to claim 11, further comprising:

an inner annulus between the inner string and the outer string; and a seal that seals and blocks flow through the inner annulus above the pump intake.

13. The apparatus according to claim 11, further comprising:

an outer tubing intake port in the outer string.

14. The apparatus according to claim 11, wherein:

the pump assembly includes an electrical motor that is electrically connected with the power line.

15. The apparatus according to claim 11, further comprising:

a latch carried by the inner string; and a seating assembly in the outer string for engagement by the latch when the inner string lands in the outer string.

16. The apparatus according to claim 11, further comprising:

a seal in an inner diameter portion of the outer string, the seal having an inner diameter smaller than a drift inner diameter of the outer tubing, the seal being in sealing engagement with a portion of the inner string; and a latch mounted to the inner string that latches to resist upward movement of the inner string relative to the outer string.

17. A well production apparatus, comprising:

a wellhead at an upper end of a well;

an electrical motor assembly having an upward extending drive shaft;

an intake housing secured to an upper end of the motor assembly, the intake housing having an outer string intake port for receiving well fluid;

a string of outer tubing secured to the intake housing on an end opposite the motor assembly, the string of outer tubing extending upward and having an upper end supported in the wellhead;

a progressive cavity pump assembly having a non-rotating stator and a rotatable rotor;

a flex shaft coupled to the rotor and extending downward into stabbing engagement with the drive shaft of the motor assembly;

a flex shaft housing extending downward from the pump assembly and enclosing the flex shaft, the flex shaft housing extending into the intake housing surrounding an upper portion of the drive shaft of the motor assembly, the flex shaft housing having a pump intake port; and a string of inner tubing secured to a discharge of the pump assembly and extending upward within the outer tubing, the string of inner tubing having an upper end suspended within to the wellhead.

18. The apparatus according to claim 17, further comprising:

a seating assembly in the intake housing; and a latch carried by the flex shaft housing that latches to the seating assembly.

19. The apparatus according to claim 17, wherein the seating assembly includes an inner annulus seal that sealingly engages the flex shaft housing.

20. The apparatus according to claim 17, further comprising:

an annular downward-facing shoulder in the intake housing; and an outward biased latch on the flex shaft housing that engages an inner wall of the outer tubing, and snaps out and latches to the shoulder as the flex shaft housing moves downward in the intake housing.

21. The apparatus according to claim 17, further comprising:

a power cable extending from the motor assembly to the wellhead along an exterior of the outer tubing.

* * * * *